US009765958B2

(12) United States Patent
Lumaye et al.

(10) Patent No.: US 9,765,958 B2
(45) Date of Patent: Sep. 19, 2017

(54) ILLUMINATED MIRROR

(71) Applicant: Séura, Inc., Green Bay, WI (US)

(72) Inventors: Andy C. Lumaye, Green Bay, WI (US); Robert J. Elsing, Green Bay, WI (US)

(73) Assignee: Séura, Inc., Green Bay, WI (US)

( * ) Notice: Subject to any disclaimer, the term of this patent is extended or adjusted under 35 U.S.C. 154(b) by 105 days.

(21) Appl. No.: 14/718,615

(22) Filed: May 21, 2015

(65) Prior Publication Data

US 2016/0341415 A1 Nov. 24, 2016

(51) Int. Cl.

| | |
|---|---|
| ***F21V 33/00*** | (2006.01) |
| ***A45D 42/10*** | (2006.01) |
| ***A47G 1/02*** | (2006.01) |
| *F21W 131/302* | (2006.01) |
| *F21Y 115/10* | (2016.01) |
| *F21Y 107/70* | (2016.01) |

(52) U.S. Cl.

CPC ..... *F21V 33/0004* (2013.01); *A45D 42/10* (2013.01); *A47G 1/02* (2013.01); *A47G 2200/08* (2013.01); *F21W 2131/302* (2013.01); *F21Y 2107/70* (2016.08); *F21Y 2115/10* (2016.08)

(58) Field of Classification Search

CPC ... F21V 33/004; F21V 33/0004; B60Q 3/023; B60Q 3/0226; F31V 33/0004; A45D 42/10; A47G 1/02

See application file for complete search history.

(56) References Cited

U.S. PATENT DOCUMENTS

| | | | | |
|---|---|---|---|---|
| 3,757,103 | A | 9/1973 | Walter | |
| 4,361,981 | A | 12/1982 | Reiling et al. | |
| 5,575,552 | A | 11/1996 | Faloon et al. | |
| 5,997,149 | A | 12/1999 | Chu | |
| 7,600,886 | B1 | 10/2009 | Sullivan et al. | |
| 7,726,617 | B2 | 6/2010 | Zambelli et al. | |
| 7,824,074 | B2 | 11/2010 | Liou et al. | |
| 8,099,247 | B2 | 1/2012 | Mischel, Jr. et al. | |
| 8,256,915 | B2 | 9/2012 | Stern et al. | |
| 8,322,673 | B2 | 12/2012 | Sculler | |
| 8,356,908 | B1 * | 1/2013 | Zadro | A45D 42/10 362/135 |
| 8,672,501 | B2 | 3/2014 | Wang et al. | |

(Continued)

FOREIGN PATENT DOCUMENTS

| | | |
|---|---|---|
| CN | 201964120 U | 9/2011 |
| JP | 06062938 A | 3/1994 |

*Primary Examiner* — Anh Mai
*Assistant Examiner* — Nathaniel Lee
(74) *Attorney, Agent, or Firm* — Michael Best & Friedrich LLP

(57) ABSTRACT

An illuminated mirror having a mirror defining a front surface and a rear surface. The mirror includes a reflective mirror portion and a translucent portion through which light can pass. A housing is secured to the rear surface of the mirror and the housing includes a first surface, a second surface, and a gap extending between the first surface and the second surface. The mirror further includes a light source coupled to a flexible substrate and positioned behind the rear surface of the mirror; and a reflective element secured to the rear surface and positioned adjacent the translucent portion of the mirror. The flexible substrate is secured to the first surface and the second surface.

20 Claims, 6 Drawing Sheets

(56) References Cited

U.S. PATENT DOCUMENTS

| | | | |
|---|---|---|---|
| 8,793,909 | B1 | 8/2014 | Cole |
| 2010/0296298 | A1 | 11/2010 | Martin, Jr. |
| 2013/0235607 | A1 | 9/2013 | Yang et al. |
| 2013/0270407 | A1 | 10/2013 | Oh |
| 2014/0016353 | A1 | 1/2014 | Chang |
| 2014/0166834 | A1 | 6/2014 | Kuroyanagi et al. |
| 2015/0036327 | A1 | 2/2015 | Uhl |
| 2015/0062877 | A1 | 3/2015 | Takes |

* cited by examiner

ILLUMINATED MIRROR

FIELD OF THE INVENTION

The present invention relates to mirrors, and more particularly illuminated mirrors.

BACKGROUND OF THE INVENTION

Lighted or illuminated mirrors include a reflective mirror surface and a light source to illuminate a user or object positioned in front of the reflective mirror surface.

SUMMARY OF THE INVENTION

The invention provides, in one aspect, an illuminated mirror having a mirror defining a front surface and a rear surface. The mirror includes a reflective mirror portion and a translucent portion through which light can pass. A housing is secured to the rear surface of the mirror and the housing includes a first surface, a second surface, and a gap extending between the first surface and the second surface. The mirror further includes a light source coupled to a flexible substrate and positioned behind the rear surface of the mirror; and a reflective element secured to the rear surface and positioned adjacent the translucent portion of the mirror. The flexible substrate is secured to the first surface and the second surface.

The invention provides, in another aspect, an illuminated mirror having a mirror defining a front surface and a rear surface. The mirror includes a reflective mirror portion and a translucent portion through which light can pass. A housing is secured to the rear surface of the mirror, and a light source is positioned behind the rear surface of the mirror. A reflective element is secured to the rear surface and positioned adjacent the translucent portion of the mirror and the light source emits light that is reflected off the reflective element and passes through the translucent portion.

The invention provides, in another aspect, an illuminated mirror having a mirror defining a front surface and a rear surface. The mirror includes a reflective mirror portion and a translucent portion through which light can pass. A housing is secured to the rear surface of the mirror, and the housing includes a first surface, a second surface non-coplanar to the first surface, and a non-orthogonal transition extending between the first surface and the second surface. A light source is coupled to a continuous flexible substrate and positioned behind the rear surface of the mirror. The continuous flexible substrate is secured to the first surface and the second surface.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
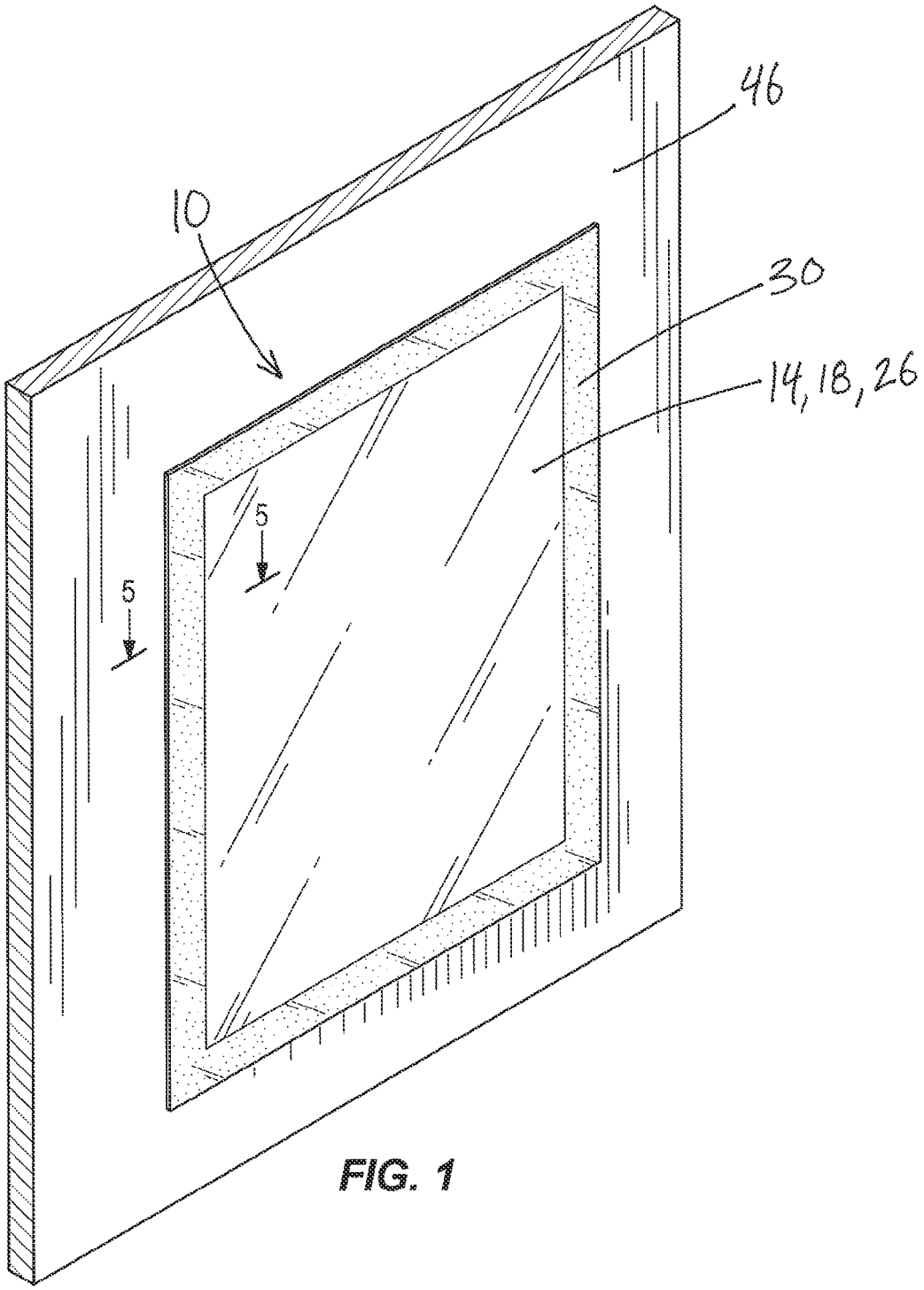
FIG. 1 is a front perspective view of an illuminated mirror in accordance with an embodiment of the invention.
Figure 3:
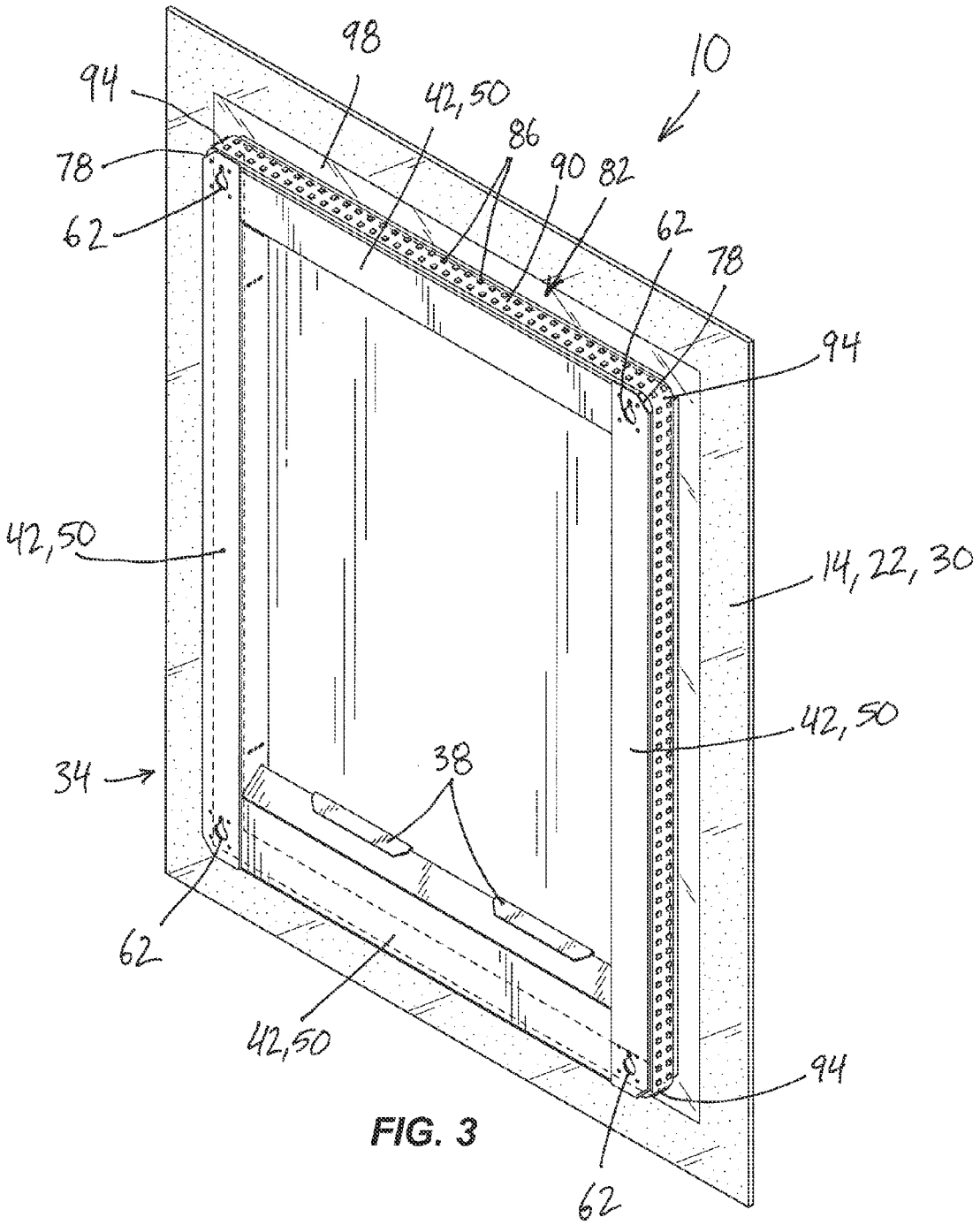
FIG. 3 is a rear perspective view of the illuminated mirror of FIG. 1.

FIG. 1 illustrates an illuminated mirror 10 (i.e., a lighted mirror) including a mirror 14 defining a front surface 18 and a rear surface 22 (FIG. 3). The mirror 14 includes a reflective mirror portion 26 in which a user may see their reflection and a translucent portion 30 through which light can pass. In the illustrated embodiment, the translucent portion 30 of the mirror 14 is frosted glass (e.g., etched or sandblasted glass) and the translucent portion 30 borders the entire reflective mirror portion 26. In alternative embodiments, the translucent portion 30 may be positioned anywhere on the front surface 18.

Figure 2:
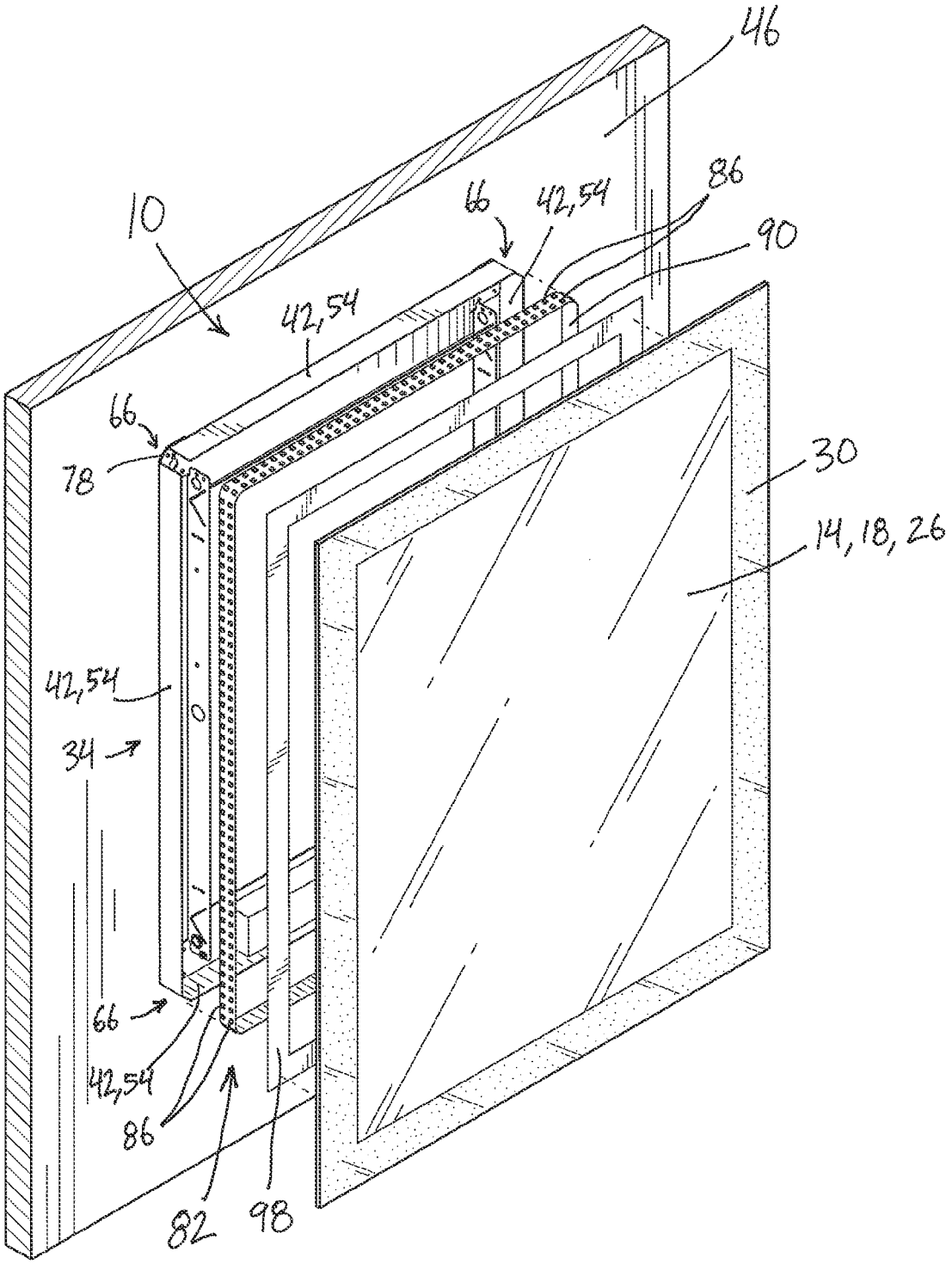
FIG. 2 is an exploded perspective view of the illuminated mirror of FIG. 1.

With reference to FIGS. 2 and 3, the illuminated mirror 10 further includes a housing 34 secured to the rear surface 22 of the mirror 14 by, for example, angled hangers 38 (e.g., French cleats). The housing 34 further includes a plurality of L-shaped brackets 42, and is operable to support the illuminated mirror 10 on a wall 46. Each of the L-shaped brackets 42 includes a wall-facing portion 50 (FIG. 3) and a forwardly-extending tab 54 (FIG. 2). The wall-facing portions 50 of the L-shaped brackets 42 are secured to each other via rivets 58 (FIG. 4), or other suitable fasteners, at the ends of the L-shaped brackets 42. Keyhole slots 62 are formed in the wall-facing portions 50 to receive an anchor (e.g., fastener, hook, etc.) secured in the wall 46, thus supporting the illuminated mirror 10 on the wall 46.

Figure 4:
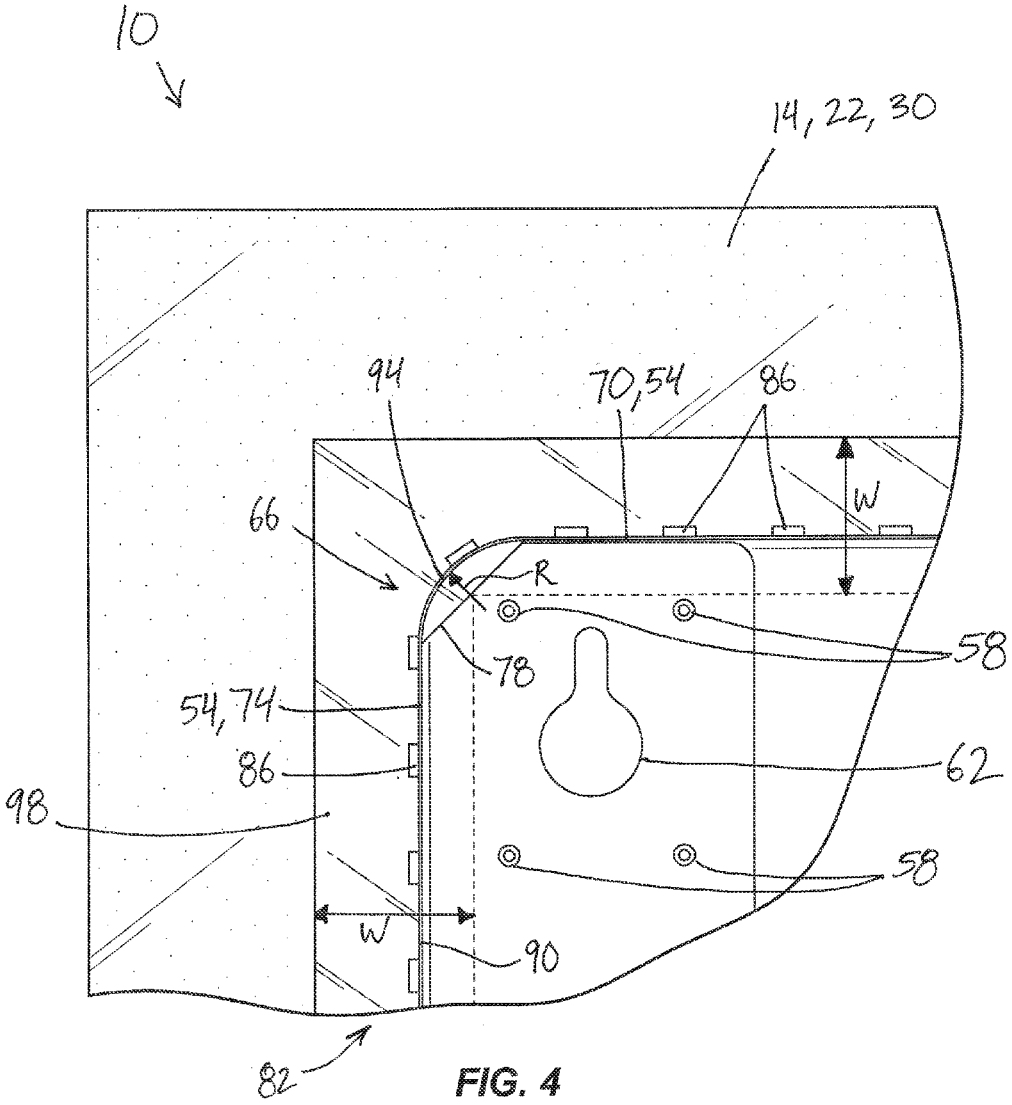
FIG. 4 is an enlarged partial rear view of the illuminated mirror of FIG. 1.

With reference to FIG. 4, each of the tabs 54 of the L-shaped brackets 42 extend orthogonally from the wall-facing portions 50, extending between the wall 46 and the rear surface 22 of the mirror 14. The forwardly-extending tabs 54 do not extend to meet each other at a 90 degree-angled corner, but rather a non-orthogonal transition is formed between each of the tabs 54. In the illustrated embodiment, the non-orthogonal transition is a gap 66 is formed between each of the tabs 54. In alternative embodiments, the non-orthogonal transition between adjacent tabs 54 includes a curved or beveled material extending between adjacent tabs 54. The gap 66 is in lieu of a sharp, 90-degree corner that would otherwise be formed between two adjacent tabs 54 if they extended to intersect each other.

In the illustrated embodiment, with reference to FIG. 4, one of the tabs 54 defines a first surface 70 and another of the tabs 54 defines a second surface 74. The first surface 70 is non-coplanar with the second surface 74, and in the illustrated embodiment, the first surface 70 is orthogonal to the second surface 74. The first surface 70 does not intersect the second surface 74, thereby forming the gap 66 extending between the first surface 70 and the second surface 74. A beveled edge 78 is formed on the wall-facing portions 50 of the L-shaped brackets 42, and the beveled edge 78 extends between the first surface 70 and the second surface 74. In other words, the housing 34 includes tabs 54 that are non-coplanar and that do not extend to intersect or meet any other of the tabs 54 creating gaps 66 (i.e., a cutout, a lack of 90-degree corner, etc.) between two adjacent tabs 54. The tabs 54 and the beveled edges 78 combined define a housing perimeter, which includes only non-orthogonal angles.

With continued reference to FIG. 2, the illuminated mirror 10 further includes a light source 82. In the illustrated embodiment, the light source 82 includes of a plurality of light sources in the form of a plurality of light emitting diodes 86 (LEDs). In alternative embodiments, a single light source, or a non-LED light source (e.g., incandescent, halogen, fluorescent, etc.) may be utilized. The light source 82 is positioned behind the rear surface 22 of the mirror 14 (i.e., positioned between the mirror 14 and the wall 46) and the LEDs 86 are oriented in a direction parallel to the rear 22 surface of the mirror 14. Each of the plurality of LEDs 86 emits light that passes through the translucent portion 30 of the mirror 14, as described in further detail below.

In the illustrated embodiment, the plurality of LEDs 86 are arranged in rows of two and are coupled to a flexible substrate 90 (e.g., a flexible electrical circuit). The flexible substrate 90 is wrapped around the housing 34 such that the flexible substrate 90 is coupled to the tabs 54, including at least the first surface 70 and the second surface 74. The flexible substrate 90 includes a curved portion 94 having a radius R that extends between the first surface 70 and the second surface 74 (FIG. 4). The flexible substrate 90 is a continuous piece of substrate that extends across the gap 66 between the first surface 70 and the second surface 74 and is coupled to both the first surface 70 and the second surface 74. The flexible substrate 90 has a minimum bend radius (e.g., between approximately ⅝" and ½") in order to prevent damage to the flexible substrate 90 by bending too sharply around a corner. In the illustrated embodiment, the flexible substrate 90 is a continuous piece of substrate that surrounds the housing perimeter (i.e., covers a majority of the perimeter). As such, the tabs 54 provide a mounting surface for the light source 82, and the non-orthogonal transitions (e.g., the gaps 66) positioned between adjacent tabs 54 allows for a continuous flexible substrate 90 to be coupled to more than one tab 54.

Figure 5:
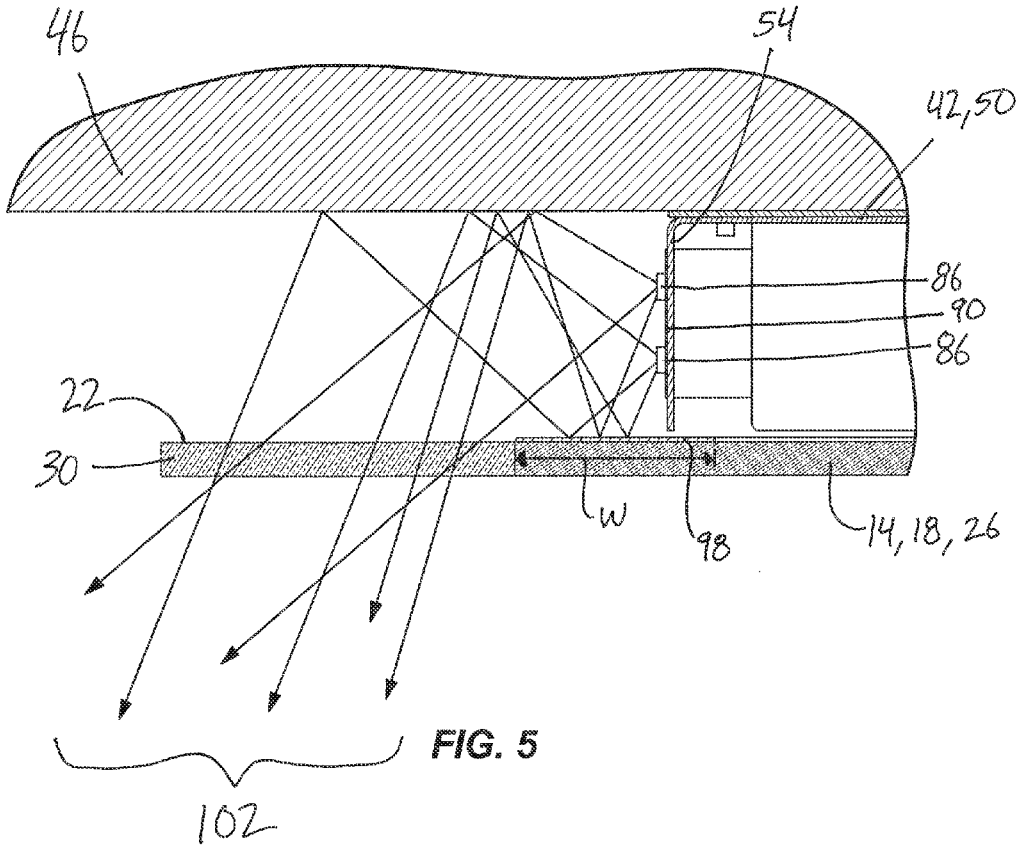
FIG. 5 is a cross-sectional view taken along lines 5-5 of the illuminated mirror in FIG. 1.

With continued reference to FIG. 2, the illuminated mirror 10 further includes a reflective element 98 secured to the rear surface 22 of the mirror 14 and positioned adjacent the translucent portion 30 of the mirror 14. In the illustrated embodiment, the reflective element 98 is a reflective tape, however, in alternative embodiments the reflective element 98 may be a reflective paint, or other suitable reflective coating. The reflective element 98 includes a reflectivity greater than approximately 85%. In some embodiments, the reflective element includes white paint having above 85% reflectivity or various tapes (e.g., mylar tape) having 98% reflectivity. In the illustrated embodiment, the reflective element 98 is positioned adjacent the entire translucent portion 30. As illustrated in FIGS. 4 and 5, the reflective element 98 has a width W that extends from the translucent portion 30 to a point behind the light source 82.

In operation, the reflective element 98 prevents light from the LEDs 86 from being absorbed by the rear surface 22 of the mirror 14. With reference to FIG. 5, light 102 emitted from the LEDs 86 is reflected by the reflective element 98 towards the wall 46, where it then reflects off a reflective surface, such as the wall 46, and passes through the translucent portion 30 of the mirror 14, thereby increasing the brightness and usable light. In other words, the light source 82 emits light 102 that is reflected off the reflective element 98 and passes through the translucent portion 30. In alternative embodiments, the reflective surface of the wall 46 may include a portion of the housing 34 extending in front of the wall 46, or a second reflective element (similar to reflective element 98) positioned on the wall 46. As such, light 102 emitted from the light source 82 is visible when viewing the front surface 18 of the mirror 14, but the light source 82 itself is not visible when viewing the front surface 18 of the mirror 14. In other words, the light source 82 remains hidden from view during normal use. For aesthetic reasons, it is desirable to have the light source 82 recessed from the translucent portion 30 so a user may view the mirror 14 at an angle with respect to the front surface 18 without directly seeing the light source 82. By keeping the light source 82 hidden, even when viewed at an angle with respect to the front surface 18, the light source 82 cannot shine directly into a user's eyes. However, the further back from the translucent portion 30 the light source 82 is positioned, the further the light 102 has to travel before reaching the front surface 18 of the mirror 14, thereby reducing the lighting efficiency and brightness. The reflective element 98 counteracts the negative effects of positioning the light source 82 recessed from the translucent portion 30 by preventing light 102 from the LEDs 86 from being absorbed by the rear surface 22 of the mirror 14. In other words, the reflective element 98 allows for the aesthetic benefit of recessing the light source 82 without a drastic reduction in brightness viewed from the front surface 18.

Figure 6:
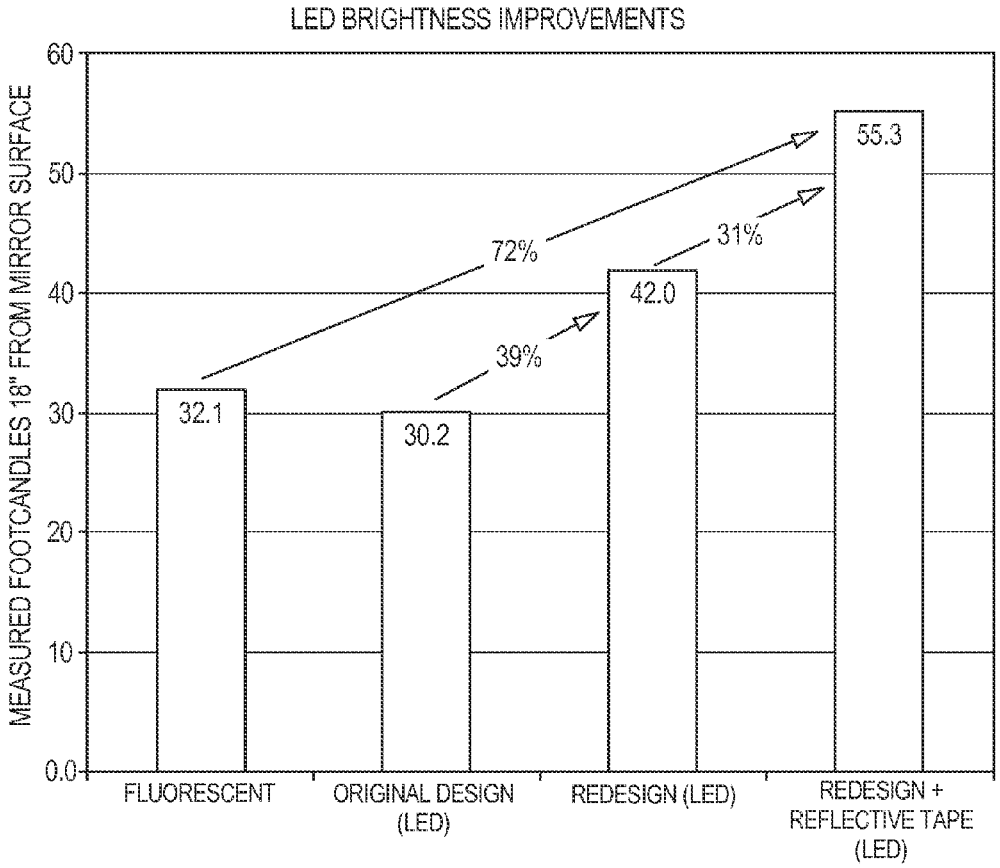
FIG. 6 is a graph of the measured foot-candles of various illuminated mirror designs.

With reference to FIG. 6, experimentally measured foot-candles at 18 inches from various designs are illustrated, showing the improvements in brightness using the invention described herein. Previous attempts to increase brightness resorted to using large quantity of or brighter light sources. The four designs compared in FIG. 6 all included the same sized mirror and the glass appears identical from the front. The designs compared in FIG. 6 are described in detail below. "Fluorescent" is a mirror lit by four fluorescent bulbs. "Original Design (LED)" replaces the fluorescent bulbs with LEDs and no other design changes. "Redesign (LED)" includes LEDs and the housing 34 as described above with the gap 66 to accommodate the flexible substrate 90 wrapping around corners of the housing, and the light source is Redesign (LED) is moved closer to the translucent portion of the mirror. "Redesign+Reflective Tape (LED)" is representative of the illustrated illuminated mirror 10, which includes the improvements described in "Redesign (LED)" and the additional of the reflective tape 98 positioned adjacent the translucent portion 30 of the mirror 14. As indicted by the comparison in FIG. 6, the measured brightness of the Redesign (LED) mirror is a 39% improvement over the Original Design (LED). Furthermore, the measured brightness of the Redesign+Reflective Tape (LED) mirror (i.e., the illuminated mirror 10) is a 31% improvement over the Redesign (LED) mirror and a 72% improvement over the Fluorescent mirror design.

Various features and advantages of the invention are set forth in the following claims.

What is claimed is:

1. An illuminated mirror comprising:

a mirror defining a front surface and a rear surface, the mirror includes a reflective mirror portion and a translucent portion through which light can pass;

a housing secured to the rear surface of the mirror, the housing including a first surface, a second surface, and a gap extending between the first surface and the second surface;

a light source coupled to a flexible substrate and positioned behind the rear surface of the mirror; and a reflective element secured to the rear surface and positioned adjacent the translucent portion of the mirror;

wherein the flexible substrate is secured to the first surface and the second surface, and wherein the first surface and the second surface are both orthogonal to the rear surface of the mirror.

2. The illuminated mirror of claim 1, wherein the light source emits light that is reflected off the reflective element and passes through the translucent portion such that the light emitted from the light source is visible when viewing the front surface of the mirror while the light source is not visible when viewing the front surface of the mirror.

3. The illuminated mirror of claim 1, wherein the translucent portion borders the entire reflective mirror portion and the reflective element is positioned adjacent the entire translucent portion.

4. The illuminated mirror of claim 1, wherein the first surface is orthogonal to the second surface and the flexible substrate includes a curved portion extending between the first surface and the second surface.

5. The illuminated mirror of claim 4, wherein the housing defines a perimeter that includes the first surface and the second surface and wherein the flexible substrate is a continuous flexible substrate that surrounds the perimeter.

6. The illuminated mirror of claim 1, wherein the light source is oriented in a direction parallel to the rear surface of the mirror.

7. The illuminated mirror of claim 1, wherein the reflective element extends from the translucent portion to a point behind the light source.

8. The illuminated mirror of claim 1, wherein the translucent portion of the mirror is etched glass.

9. The illuminated mirror of claim 1, wherein the light source is one of a plurality of light sources.

10. The illuminated mirror of claim 9, wherein the plurality of light sources are light emitting diodes.

11. An illuminated mirror comprising:

a mirror defining a front surface and a rear surface, the mirror includes a reflective mirror portion and a translucent portion through which light can pass;

a housing secured to the rear surface of the mirror, the housing including a first surface, a second surface non-coplanar to the first surface, and a non-orthogonal transition extending between the first surface and the second surface; and a light source coupled to a continuous flexible substrate and positioned behind the rear surface of the mirror;

wherein the continuous flexible substrate is secured to the first surface and the second surface, and wherein the first surface is orthogonal to the second surface and the flexible substrate includes a curved portion extending between the first surface and the second surface.

12. The illuminated mirror of claim 11, wherein the non-orthogonal transition is a gap extending between the first surface and the second surface.

13. The illuminated mirror of claim 11, wherein the housing defines a perimeter that includes at least the first surface and the second surface and wherein the flexible substrate is a continuous flexible substrate that surrounds the perimeter.

14. The illuminated mirror of claim 11, wherein a beveled edge extends between the first surface and the second surface.

15. The illuminated mirror of claim 11, wherein the housing defines a perimeter that includes only non-orthogonal angles.

16. An illuminated mirror comprising:

a mirror defining a front surface and a rear surface, the mirror includes a reflective mirror portion and a translucent portion through which light can pass;

a housing secured to the rear surface of the mirror, the housing including a first surface, a second surface, and a gap extending between the first surface and the second surface;

a light source coupled to a flexible substrate and positioned behind the rear surface of the mirror; and a reflective element secured to the rear surface and positioned adjacent the translucent portion of the mirror;

wherein the flexible substrate is secured to the first surface and the second surface, and wherein the first surface is orthogonal to the second surface and the flexible substrate includes a curved portion extending between the first surface and the second surface.

17. The illuminated mirror of claim 16, wherein the light source emits light that is reflected off the reflective element and passes through the translucent portion such that the light emitted from the light source is visible when viewing the front surface of the mirror while the light source is not visible when viewing the front surface of the mirror.

18. The illuminated mirror of claim 16, wherein the translucent portion borders the entire reflective mirror portion and the reflective element is positioned adjacent the entire translucent portion.

19. The illuminated mirror of claim 16, wherein the housing defines a perimeter that includes the first surface and the second surface and wherein the flexible substrate is a continuous flexible substrate that surrounds the perimeter.

20. The illuminated mirror of claim 16, wherein the light source is one of a plurality of light sources.

* * * * *